US006471318B2

(12) United States Patent
Fujii

(10) Patent No.: US 6,471,318 B2
(45) Date of Patent: Oct. 29, 2002

(54) INK JET RECORDING HEAD, DRIVING CONDITION SETTING METHOD THEREOF, AND INK JET RECORDING DEVICE

(75) Inventor: Masahiko Fujii, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/052,529

(22) Filed: Jan. 23, 2002

(65) Prior Publication Data

US 2002/0109754 A1 Aug. 15, 2002

(30) Foreign Application Priority Data

Feb. 14, 2001 (JP) ..... 2001-037441

(51) Int. Cl.[7] ..... B41J 29/38; B41J 2/05
(52) U.S. Cl. ..... 347/9; 347/14; 347/57
(58) Field of Search ..... 347/5, 9, 10, 11, 347/57, 60, 13, 14, 15, 56, 42, 65, 94

(56) References Cited

U.S. PATENT DOCUMENTS 4,380,771 A * 4/1983 Takatori ..... 347/65
4,878,992 A * 11/1989 Campanelli ..... 347/56
5,036,337 A * 7/1991 Rezanka ..... 347/11
5,412,410 A * 5/1995 Rezanka ..... 347/15
5,497,174 A * 3/1996 Stephany et al. ..... 347/13

FOREIGN PATENT DOCUMENTS

| | | | |
|---|---|---|---|
| JP | 5-24203 | 2/1993 | ..... B41J/2/16 |
| JP | 2783647 | 5/1998 | ..... B41J/2/05 |
| JP | 2877589 | 1/1999 | ..... B41J/2/05 |
| JP | 11-227208 | 8/1999 | ..... B41J/2/05 |
| JP | 2000-243674 | 9/2000 | ..... H01L/21/02 |

* cited by examiner

*Primary Examiner*—John Barlow
*Assistant Examiner*—Juanita Stephens
(74) *Attorney, Agent, or Firm*—Morgan, Lewis & Bockius LLP

(57) ABSTRACT

A driving condition setting method of an ink jet recording head enables stable discharge of an ink drop irrespective of a difference in a channel volume. In a thermal ink jet recording head, the displacement of a distance (channel volume) from a heating element to a nozzle surface is stored as data into a memory. The ink jet recording head is mounted on an ink jet recording device. A control unit of the ink jet recording device reads the data so as to set a driving condition (the number of pre-pulses) of the heating element based on the data. Therefore, even when the channel volume is displaced by a production error, an ink discharge state can be almost constant, and stable printing performance can be ensured.

12 Claims, 8 Drawing Sheets

*FIG. 6*

| CLASS | DISPLACEMENT AMOUNT OF DICING POSITION FROM DESIGN ($\mu$m) |
|---|---|
| 1 | -10 ~ -6 |
| 2 | -6 ~ -2 |
| 3 | -2 ~ +2 |
| 4 | +2 ~ +6 |
| 5 | +6 ~ +10 |

*FIG. 8*
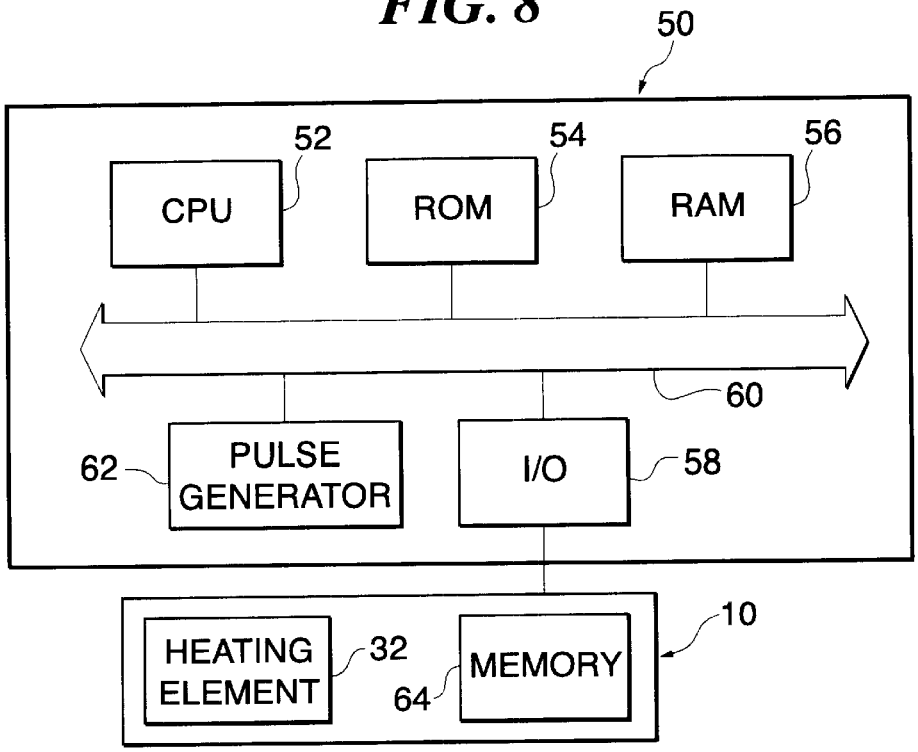
*FIG. 9*
| CLASS | DRIVING CONDITION | DRIVING PULSE CONDITION | |
|---|---|---|---|
| | | PRE-PULSE | MAIN PULSE |
| 1 | A | NONE | 1.8 μs |
| 2 | B | TWO PRE-PULSES OF 0.1 μs | 1.8 μs |
| 3 | C | FOUR PRE-PULSES OF 0.1 μs | 1.8 μs |
| 4 | D | SIX PRE-PULSES OF 0.1 μs | 1.8 μs |
| 5 | E | EIGHT PRE-PULSES OF 0.1 μs | 1.8 μs |
*FIG. 10*
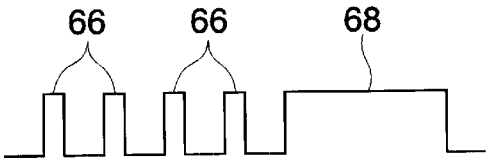

INK JET RECORDING HEAD, DRIVING CONDITION SETTING METHOD THEREOF, AND INK JET RECORDING DEVICE

BACKGROUND OF THE INVENTION

1. Field of the Invention

The present invention relates to an ink jet recording head which can discharge an ink drop onto a recording medium corresponding to image information for recording, a driving condition setting method thereof, and an ink jet recording device.

2. Description of the Related Art

As an ink jet recording method which can discharge an ink drop from a nozzle onto paper corresponding to an image signal for recording, there is a thermal ink jet method including the steps of: applying an electric pulse, as a driving force for discharging an ink drop from a nozzle, to an electrothermal conversion element (hereinafter, referred to as heating element); producing a bubble by heat generation of a heating element; and discharging an ink drop from the nozzle by pressure of the bubble.

The thermal ink jet method has the problem that the ink temperature is raised by discharge of an ink drop so that the volume of the ink drop is varied due to viscosity change.

To solve this, as shown in U.S. Pat. No. 2,783,647 (hereinafter, referred to as a Related Art 1), there is proposed an ink jet recording method in which a bubble produced on a heating element grows to be communicated to atmosphere so as to discharge an ink drop having a constant volume irrespective of environment temperature and head temperature. This will not allow a bubble to disappear on the heating element. Therefore no cavitation damage when a bubble disappears can be given to the heating element. The life of the heating element can be increased.

The Related Art 1 also discloses that, in order to prevent image contamination due to splash or mist produced when a bubble is communicated to atmosphere, a bubble is communicated to atmosphere on condition that the internal pressure of the bubble is lower than the atmospheric pressure.

Ink mist is attached onto paper because a bubble is communicated to atmosphere before the internal pressure of the bubble produced by driving a heating element is lower than the atmospheric pressure, whereby a pressure gradient is produced from a nozzle to atmosphere. A bubble is communicated to atmosphere after the internal pressure of the bubble is lower than the atmospheric pressure to provide a pressure gradient toward the inside of a nozzle, whereby ink mist is prevented from being attached onto paper.

To achieve the abovementioned relation, the relation between timing for communicating atmosphere and a bubble to each other and a channel volume from a heating element to a nozzle will be described with reference to FIG. 13 showing typical change of bubble internal pressure with time.

FIG. 13 shows results of head constructions a, b and c which change a distance from a heating element to a nozzle to vary a channel volume in which the driving condition (bubble volume produced) of a heating element is constant to calculate timing for communicating a bubble to atmosphere by a fluid simulation. Here, when the respective channel volumes are Va, Vb and Vc, the relation is $Va<Vb<Vc$.

As shown in FIG. 13, in the construction a in which a channel volume from a heating element to a nozzle is too small, a bubble is communicated to atmosphere (the bubble internal pressure is higher than the atmospheric pressure) before time t1 at which the bubble internal pressure and the atmospheric pressure are equal to each other, whereby ink mist is attached onto paper. In the construction c in which a channel volume from a heating element to a nozzle is too large, a bubble is not communicated to atmosphere, whereby the abovementioned effect for discharging an ink drop having a constant volume irrespective of temperature and for increasing the life of the heating element cannot be obtained.

The relation between a channel volume from a heating element to a nozzle and a driving condition of the heating element (the volume of a bubble produced by the heating element) governs timing for communicating atmosphere and a bubble to each other.

From such a point of view, U.S. Pat. No. 2,877,589 (hereinafter, referred to as a Related Art 2) discloses that the size of a heating element and a channel volume to a nozzle are defined within a certain range.

The Related Arts 1 and 2 each disclose a construction which can prevent ink mist contamination and discharge an ink drop having a constant volume irrespective of temperature.

It is difficult, however, to produce a channel volume within a certain range due to a production error of an ink jet recording head. In the production process of an ink jet recording head (head chip), the following factors which fluctuate a channel volume from a heating element to a nozzle can be considered.

For example, in an ink jet recording head in which a nozzle plate is stuck onto a member formed with an ink channel to form a nozzle in the nozzle plate, the thickness of the nozzle plate may not be a desired thickness and, when forming a nozzle, a nozzle of a desired size may not be formed.

In addition, in an ink jet recording head in which a channel substrate formed with a channel and a heating element substrate formed with a heating element are joined together so as to form a nozzle surface by dicing, the dicing position may be displaced.

In such a case, the channel volume from a heating element to a nozzle is outside the defined range. As in the Related Arts 1 and 2, atmosphere and a bubble cannot be communicated to each other at a predetermined timing, so that desired operations (discharge of an ink drop having a constant volume and prevention of ink mist contamination) cannot be achieved.

However, when the allowed volume of a channel size is strictly defined in order to allow a bubble volume and a channel volume to be in a predetermined relation, the yield of the ink jet recording head in the head production process can be lowered and the production cost can be increased.

SUMMARY OF THE INVENTION

The present invention has been made in view of the above circumstances and provides a driving condition setting method of an ink jet recording head, an ink jet recording head, and an ink jet recording device, which can ensure desired printing performance irrespective of fluctuation of the channel volume for each head chip.

According to the present invention, a driving condition setting method of an ink jet recording head having an individual channel in which a heating element is placed for heating ink to produce a bubble and an ink discharge portion at an edge of the individual channel, includes the step of setting a driving condition of the heating element corresponding to a difference in a channel volume of the individual channel from the heating element to the ink discharge portion due to a production error.

In this manner, a driving condition applied to a heating element corresponding to a difference in a channel volume of an individual channel from the heating element to the ink discharge portion is set. Specifically, in the ink jet recording head production process, when a channel volume from the heating element to the ink discharge portion is displaced from a predetermined value, the condition to drive a heating element is changed corresponding to the displacement amount to vary the volume of a bubble produced by the heating element. The channel volume from the heating element to the nozzle and the bubble volume are allowed to be in a predetermined relation. For example, when a channel volume is small, energy to applied to the heating element is lowered to decrease the volume of a bubble produced in ink. When a channel volume is large, energy to be applied to the heating element is raised to increase the volume of a bubble produced in ink.

The bubble volume and the channel volume are allowed to be in a predetermined relation. When ink is discharged, a bubble can be communicated to atmosphere at any time at the internal pressure of the bubble lower than the atmospheric pressure. Therefore, an ink drop having a constant volume can be discharged irrespective of environment temperature and head temperature, and image deterioration due to splash or mist can be prevented.

An ink jet recording head of the present invention includes: an individual channel in which a heating element is placed for heating ink to produce a bubble; an ink discharge portion at an edge of the individual channel; and a data holding unit for storing channel volume data based on a channel volume of the individual channel from the heating element to the ink discharge portion.

The ink jet recording head is provided with a data holding unit for storing channel volume data. Therefore, even when the production accuracy of the ink jet recording head is low, a driving condition of a heating element is set based on the channel volume data so as to allow the channel volume and the bubble volume to be in a predetermined relation. The ink jet recording head which can suppress the volume fluctuation of an ink drop with temperature change and achieve prevention of ink mist contamination can be obtained without lowering the yield.

An ink jet recording device of the present invention includes a driving condition setting part which reads channel volume data of the recording head to set a driving condition of the heating element by mounting the ink jet recording head according to one aspect of the present invention.

The abovementioned ink jet recording head is mounted to read the channel volume data of the ink jet recording head and set a driving condition of a heating element according to the data. Therefore, the bubble size and the channel volume of the ink jet recording head are allowed to be in a predetermined relation, and prevention of ink mist contamination and a constant ink drop volume can be achieved.

In the ink jet recording head, a position of the heating element is set so that a bubble produced on the heating element grows to be communicated to atmosphere, thereby discharging an ink drop.

In the ink jet recording head, a unique driving condition data corresponding to head chip dicing displacement due to a production error is held for each head chip.

BRIEF DESCRIPTION OF THE DRAWINGS

Preferred embodiments of the present invention will be described in detail based on the followings, wherein:

FIG. 6 is a table showing classification based on a dicing position in the embodiment;

FIG. 8 is a block diagram showing a control unit of an ink jet recording head according to the embodiment of the present invention;

FIG. 9 is a driving pulse setting condition table corresponding to classification of a nozzle dicing position according to the embodiment of the present invention;

FIG. 10 is a pulse waveform diagram showing driving pulses for driving a heating element according to the embodiment of the present invention;

DESCRIPTION OF THE PREFERRED EMBODIMENTS

An ink jet recording head, a driving condition setting method thereof, and an ink jet recording device according to an embodiment of the present invention will be described.

Figure 1:
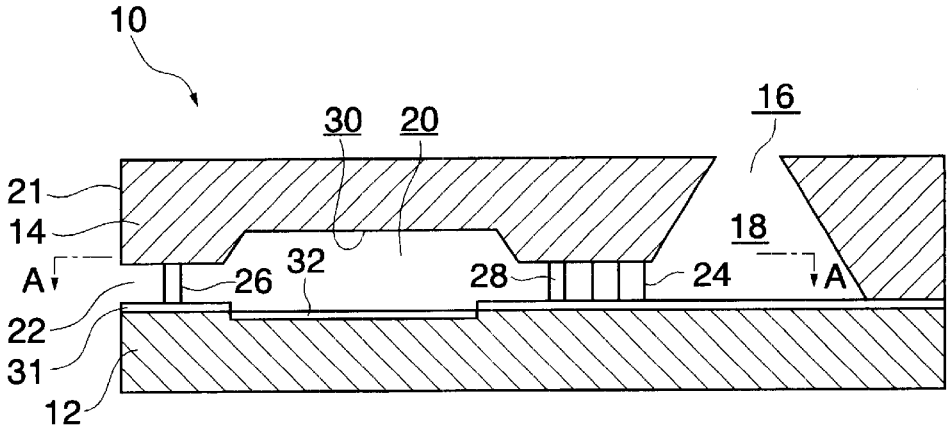
FIG. 1 is a schematic sectional view of an ink jet recording head according to an embodiment of the present invention.
Figure 2:
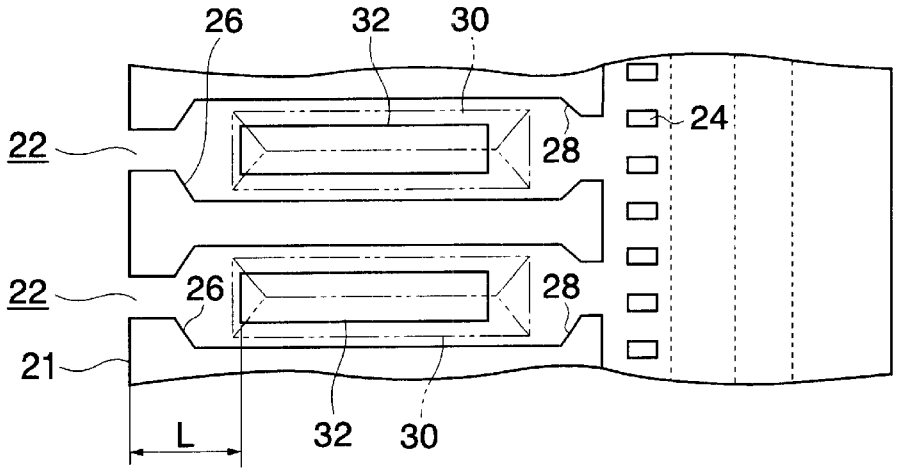
FIG. 2 is a cross-sectional view taken along line A—A of FIG. 1.

As shown in FIGS. 1 and 2, an ink jet recording head 10 is formed by joining a heating element substrate 12 to a channel substrate 14. Ink supplied from an ink supply opening 16 opened into the surface of the channel substrate 14 passes through a common liquid chamber 18 and an individual channel 20 and is discharged, as an ink drop, from a nozzle 22 opened into a nozzle end surface 21.

As shown in FIG. 2, near the individual channel 20 of the common liquid chamber 18, a filter 24 formed with pillars at fixed intervals is formed so as to prevent the individual channel 20 from being clogged by particles of dust flowed into the common liquid chamber 18 and ink drop discharge from being disabled.

The individual channel 20 is provided at the nozzle side with a forward throttle 26 and at the common liquid chamber side with a rearward throttle 28, and with a recession 30. An ink drop can be efficiently discharged by the later-described bubble.

The heating element substrate 12 is formed in its surface with a protective layer 31 in order to protect a circuit formed on the substrate surface from ink and a heating element 32 exposed to the surface of the protective layer 31 is placed in the position corresponding to the recession 30 of the channel substrate 14.

The ink jet recording head 10 has a memory 64 (see FIG. 8) which stores the later-described class information corresponding to a channel volume of the individual channel 20 from the heating element 32 to the nozzle 22. In this embodiment, the class information is a production error (displacement) amount of a distance (dicing position) L from the edge of the heating element 32 to the nozzle end surface 21 of the individual channel 20.

A method for detecting the production error amount will be described simply hereinbelow with a method for producing the ink jet recording head 10.

Figure 3:
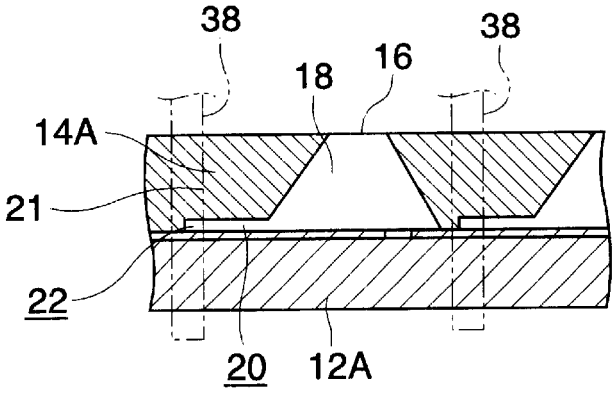
FIG. 3 is a diagram of assistance in explaining an ink jet recording head production state according to the embodiment of the present invention.

The method for producing the ink jet recording head 10 will be simply described with reference to FIG. 3.

Plural channel substrates 14 are produced on a disk-like substrate 14A. As shown in Japanese Published Unexamined Patent Application No. Hei 11-227208, into a portion corresponding to each of the channel substrates 14 formed on the substrate 14A, the ink supply opening 16 and the common liquid chamber 18 for supplying ink from an external ink tank to the ink jet recording head 10 are produced by wet anisotropic etching. The individual channel 20 is produced by reactive ion etching because the shape accuracy is required.

Plural heating element substrates 12 are produced on a disk-like substrate 12A. The heating element 32 is formed into a portion corresponding to each of the heating element substrates 12 formed on the substrate 12A.

The channel substrate 14 and the heating element substrate 12 formed in this manner are joined together after alignment and are then cut in a rectangular shape along a dicing line 38 by means of, e.g., a dicer for separation, thereby providing the individual ink jet recording heads 10. At this time, the diced end surface of the substrates 12A and 14A is the nozzle surface 21 of the ink jet recording head 10 and the nozzle 22 is opened into the nozzle surface 21.

Figure 4:
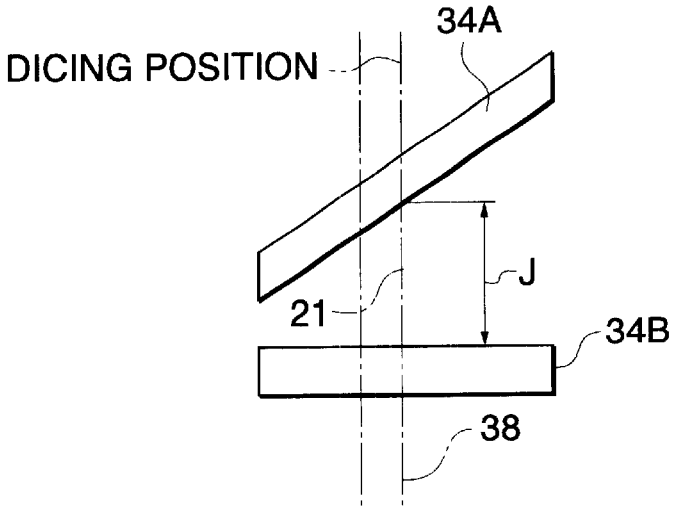
FIG. 4 is a plan view showing an example of a pattern for inspecting a distance from a heating element to a nozzle formed on a substrate according to the embodiment of the present invention.

As shown in Japanese Published Unexamined Patent Application No. 2000-243674, a pattern which can detect the dicing position (production error) from the nozzle surface 21 in the position across the dicing line 38 on the substrate 12A is formed on the substrate 12A by, for example, A1. One example of this pattern is shown in FIG. 4.

Figure 5:
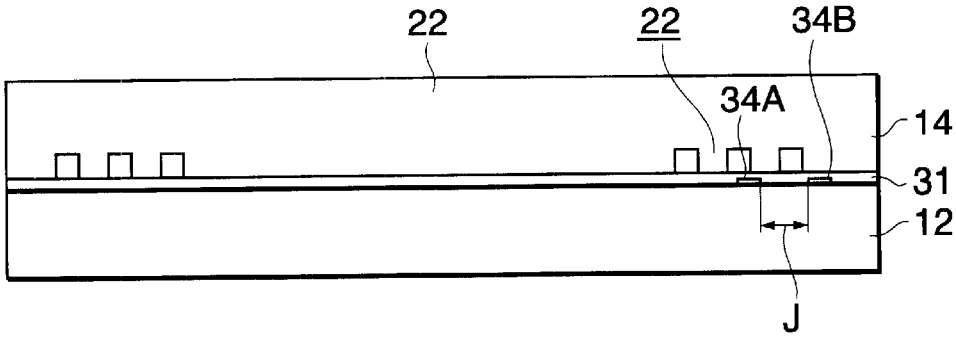
FIG. 5 is a front view of an ink jet recording head showing a state that the pattern is exposed from the nozzle surface.

Two linear patterns 34A and 34B which are not parallel with each other are formed across the dicing line 38. The dicing position (a distance L from the edge of the heating element 32 to the nozzle surface 21) is detected by a distance J between the patterns 34A and 34B exposed from the nozzle surface 21 by dicing (see FIGS. 4 and 5).

When the dicing position is displaced from the designed value, the distance J between the patterns 34A and 34B is changed in the cut nozzle surface 21. The distance J is measured in the head production process or the inspection process to detect the dicing position, that is, the displacement amount of the distance L from the heating element 32 to the nozzle 22.

The displacement amount of the channel volume should be obtained here. In the head production method, the individual channel 20 and the nozzle 22 are formed by reactive ion etching. The production accuracy of the channel is very high, so that the channel cross-sectional area and the nozzle area can be produced as designed mostly. When the displacement amount of the dicing position is detected, a displacement amount of a channel volume from the heating element 32 to the nozzle 22 from the designed value can be assumed.

A displacement amount of the dicing position (the distance L from the heating element 32 to the nozzle surface 21) is calculated based on the distance J detected in the inspection process to perform five-stage class classification as shown in FIG. 6 based on the displacement amount. The class information is written into the memory 64 (see FIG. 8) of the ink jet recording head 10 by an input device. For example, when a displacement amount of the dicing position due to a production error of the ink jet recording head 10 is within ±2 μm, information of class 3 is written. The class information is written into the memory 64, but may be written into a fuse circuit to cut off wiring.

An ink jet recording device mounting an ink cartridge formed integrally with such an ink jet recording head 10 will be described.

Figure 7:
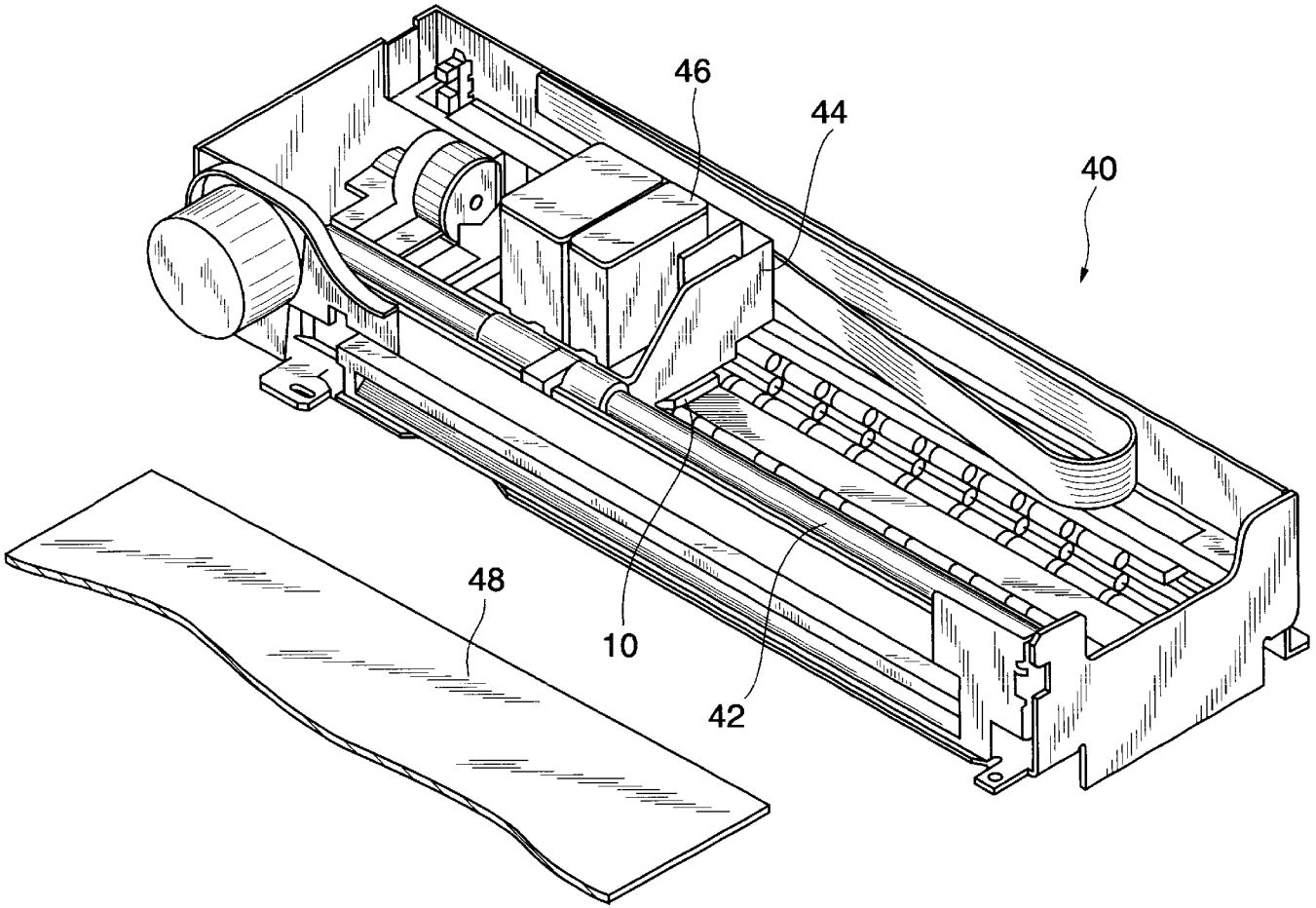
FIG. 7 is a perspective view showing an ink jet recording device according to the embodiment of the present invention.

As shown in FIG. 7, an ink jet recording device 40 has an ink cartridge 46 mounted on a carriage 44 moved along a guide shaft 42. An ink drop is discharged from the ink jet recording head 10 integrally provided at the edge of the ink cartridge onto paper 48 to record an image onto the paper 48.

As shown in FIG. 8, the ink jet recording device 40 has a control unit 50. The control unit 50 has a CPU 52, a ROM 54, a RAM 56 and an I/O 58, which are connected by a bus 60. The ROM 54 stores the later-described driving condition setting table. The control unit 50 also has a pulse generator 62 for outputting a pulse signal for driving the heating element 32.

A pulse signal outputted from the pulse generator 62 to the heating element 32 has pre-pulses 66 and a main pulse 68, as shown in FIG. 10 and changes the number of the pre-pulses based on the later-described driving condition set based on the class information.

As shown in FIG. 9, the driving condition setting table sets a driving pulse condition for driving the heating element 32 based on the class information read from the memory 64 of the ink jet recording head 10.

The ink jet recording head 10 inputs a driving pulse corresponding to a channel volume to the heating element 32. As shown in schematic diagrams of FIGS. 12A to 12E, the ink jet recording head 10 changes the volume of a bubble 72 produced in ink 70 of the individual channel 20 by the heating element 32, and communicates the bubble 72 to atmosphere when discharging an ink drop 74, thereby discharging the ink drop 74 having a constant volume.

Figure 13:
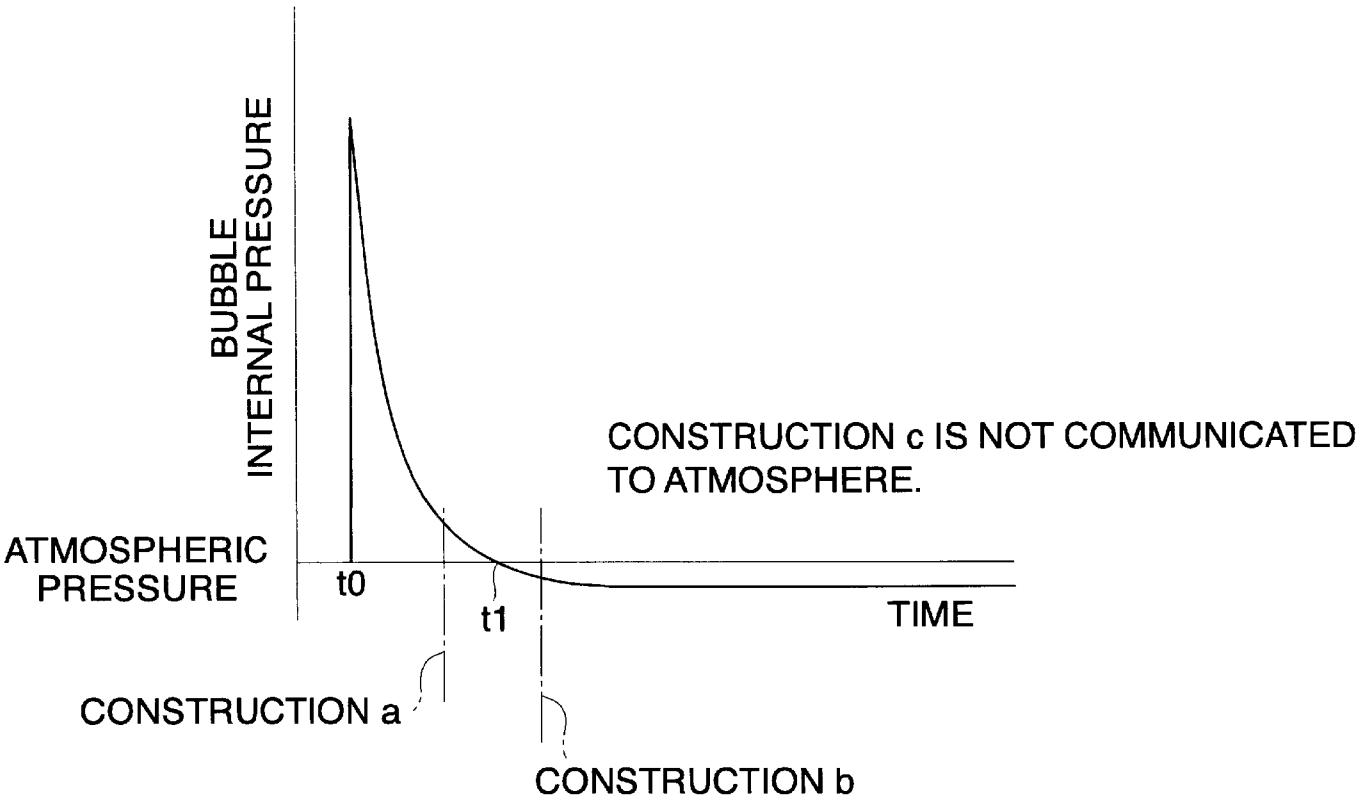
FIG. 13 is a graph showing change over time of bubble internal pressure of the ink jet recording head.

The internal pressure of the bubble 72 produced by driving the heating element 32 is changed as shown in FIG. 13. After the internal pressure of the bubble is lower than the atmospheric pressure (after time t1), the bubble is communicated to atmosphere. The driving pulse condition is set in this manner so that the bubble internal pressure is lower than the atmospheric pressure when the bubble is communicated to the atmosphere, and ink mist is drawn into the nozzle and cannot be attached onto the paper.

However, when the channel volume is fluctuated due to a production error of the ink jet recording head 10, the ink discharge state is changed in the case where the driving condition (driving pulse) of the heating element 32 is constant. For example, in the case where a channel volume is decreased, the bubble 72 is communicated to atmosphere when the internal pressure of the bubble 72 is higher than the atmospheric pressure, whereby ink mist is attached onto the paper. When a channel volume is increased, the bubble 72 cannot be communicated to atmosphere so that the volume of the ink drop 72 is fluctuated due to environment temperature and head temperature.

A table for setting a driving condition (the number of the pre-pulses) corresponding to the displacement amount of the dicing position (channel volume) is provided.

Specifically, as shown in FIG. 6, driving conditions A to E respectively correspond to classes 1 to 5 of the head. The condition C of these is a normal driving pulse condition. To the ink jet recording head 10 having a channel volume smaller than a predetermined channel volume, that is, to the ink jet recording head 10 classified into class 1 or 2, a driving condition having the number of the pre-pulses 66 smaller than that of the condition C is applied so as to make the volume of the bubble 72 produced by the heating element 32 smaller than normal. This makes the volume of the bubble 72 produced by the heating element 32 small. The bubble volume and the channel volume are allowed to be in a predetermined relation. The bubble 72 is thus communicated to atmosphere with predetermined timing. To the ink jet recording head 10 having a channel volume larger than a predetermined channel volume, that is, to the ink jet recording head 10 classified into class 4 or 5, the number of the pre-pulses 66 is larger than that of the condition C and the volume of the bubble 72 produced by the heating element 32 is larger than normal to discharge ink with predetermined timing. In this embodiment, in both cases, the interval between the pre-pulses is 0.3 $\mu$s.

The operation (the driving condition setting method) of the ink jet recording head 10 (the ink jet recording device 40) thus constructed will be described.

The ink cartridge 46 is mounted on the ink jet recording device 10. The control unit 50 reads the class information from the memory 64 of the ink jet recording head 10 to set a driving condition based on the driving condition setting table stored into the ROM 54.

For example, when a displacement amount of the dicing position due to a production error of the ink jet recording head 10 is within ±2 $\mu$m, the class information shows class 3. The driving condition C with four pre-pulses 66 of 0.1 $\mu$s and one main pulse 68 of 1.8 $\mu$s is set. The driving condition C is stored into the RAM.

When an image output signal is inputted to the ink jet recording device 40, the pulse generator 62 of the control unit 50 generates a pulse signal based on the driving condition C stored into the RAM 54 and then outputs the pulse signal to the ink jet recording head 10 (the heating element 32). In other words, a pulse signal with four pre-pulses 66 of 0.1 $\mu$s and one main pulse 68 of 1.8 $\mu$s for discharge of one ink drop is outputted to drive the heating element 32. As a result, the channel volume and the volume of the bubble 72 produced in ink of the individual channel 20 are allowed to be in a predetermined relation. Atmosphere and the bubble 72 are communicated to each other before discharging the ink drop 74 to make the volume of the ink drop 74 constant irrespective of the head temperature. The internal pressure of the bubble 72 is lower then the atmospheric pressure when the bubble 72 is communicated to the atmosphere. Thus, ink mist cannot be attached onto the paper.

In this manner, the ink jet recording head 10 holds as class information the respective channel volume information (the displacement amount of the dicing position). The ink jet recording head 10 (the ink cartridge 46) is mounted on the ink jet recording device 40. The control unit 50 of the ink jet recording device 40 reads the class information to set a driving condition of the heating element 32 according to the channel volume. An ink drop having a constant volume can be discharged regardless of a production error of the ink jet recording head 10 irrespective of change of the environment temperature and head temperature. Ink mist attachment onto the paper 48 can be prevented.

Figure 11:
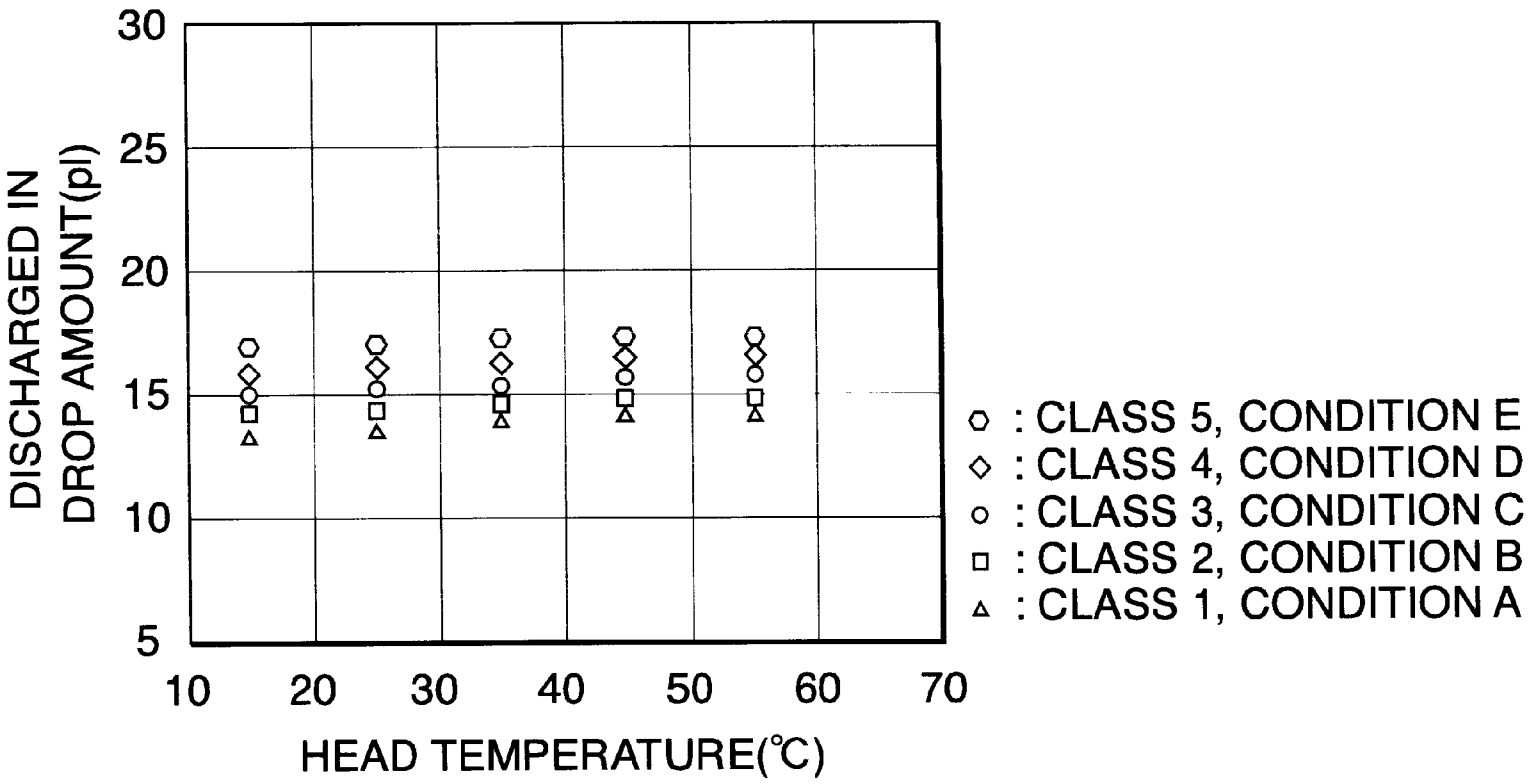
FIG. 11 is a diagram showing the relation between head temperature and discharged ink drop amounts according to the embodiment.
Figure 12A:
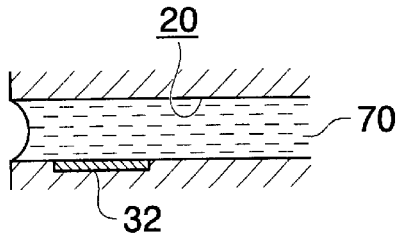
FIGS. 12A to 12E is a schematic diagram of assistance in explaining ink drop phenomena in the ink jet recording head according to the embodiment of the present invention.
Figure 12B:
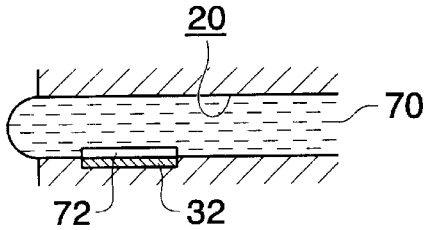
Figure 12C:
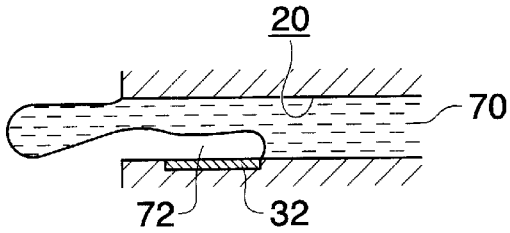
Figure 12D:
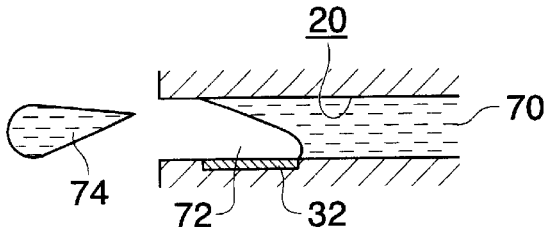
Figure 12E:
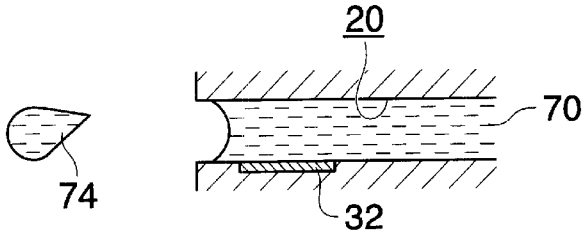

FIG. 11 shows the relation between the head temperature and the discharged ink drop amount when the ink jet recording heads classified into classes 1 to 5 are driven under the respective driving conditions. The designed ink drop volume is 15 pl.

The discharged ink drop volumes are displaced from the designed value of 15 pl based on the classes (the displacement amounts of the dicing position). It is confirmed that ink drops having an almost constant volume can be discharged even when the head temperature is changed. Image deterioration due to splash or mist cannot be found in any of the ink jet recording heads.

The ink drop amount difference based on the head class is varied for each printer. When it is above the minimum print density required, the difference of this degree will not be a significant problem.

In this embodiment, the type in which a bubble is communicated to atmosphere when discharging ink is described. This embodiment can also be applied to a type in which a bubble is not communicated to atmosphere.

As a pattern for inspecting a distance from the heating element 32 to the nozzle surface 21, that is, a channel volume, as shown in Japanese Published Unexamined Patent Application No. Hei 5-24203, grooves are provided at the channel substrate side by the same method as the channel production method, and the number of the grooves is counted from the nozzle surface to measure a distance from the heating element 32 to the nozzle surface 21.

When the method for producing the ink jet recording head 10 is different, a driving condition may be set based on the displacement amount of a channel volume (or a parameter thereof) in place of displacement of the dicing position.

In an ink jet recording head which can communicate a bubble to atmosphere so as to discharge an ink drop having a constant volume irrespective of environment temperature and head temperature, a driving condition of the heating element is changed by a channel volume from the heating element to the nozzle surface. Discharge of an ink drop having a constant volume can be implemented irrespective of the displacement of the channel volume and image deterioration due to splash or mist can be prevented. The ink jet recording head having the abovementioned effect can be produced without lowering the yield.

The entire disclosure of Japanese Patent Application No. 2001-37441 filed on Feb. 14, 2001 including specification, claims, drawings and abstract is incorporated herein by reference in its entirety.

What is claimed is:

1. A driving condition setting method of an ink jet recording head having an individual channel in which a heating element is placed for heating ink to produce a bubble and an ink discharge portion at an edge of the individual channel, the method comprising:

setting a driving condition of the heating element corresponding to a difference in a channel volume of the individual channel from the heating element to the discharge portion due to a production error.

2. The driving condition setting method of an ink jet recording head according to claim 1, wherein the difference in a channel volume from the heating element to the discharge portion is a difference in a distance from the heating element to the discharge portion.

3. The driving condition setting method of an ink jet recording head according to claim 1, wherein a driving condition of the heating element is set so that a bubble produced in ink by driving the heating element is communicated to atmosphere when an ink drop is discharged from the ink discharge portion.

4. An ink jet recording head comprising:

an individual channel in which a heating element is placed for heating ink to produce a bubble;

an ink discharge portion at an edge of the individual channel; and a data holding unit that stores channel volume data based on a channel volume of the individual channel from the heating element to the ink discharge portion.

5. The ink jet recording head according to claim 4, wherein the channel volume data is distance data from the heating element to the ink discharge portion.

6. The ink jet recording head according to claim 4, wherein the channel volume data is production error data.

7. The ink jet recording head according to claim 4, wherein the bubble produced in the ink by driving the heat element is communicated to the atmosphere when an ink drop is discharged from the ink discharge portion.

8. The ink jet recording head according to claim 4, comprising a substrate with a groove as the individual channel and a substrate with a heating element formed, the both substrates being joined and cut to form a nozzle surface as the discharge portion.

9. The ink jet recording head according to claim 8, wherein the individual channel and an opening at the ink discharge portion are formed by reactive ion etching.

10. The ink jet recording head according to claim 4, wherein a position of the heating element is set so that a bubble produced on the heating element grows to be communicated to the atmosphere, thereby discharging an ink drop.

11. The ink jet recording head according to claim 4, wherein unique driving condition data is held for each head chip.

12. An ink jet recording device comprising:

a driving condition setting part which reads, when an ink jet recording head is mounted to the device, channel volume data of the ink jet recording head to set a driving condition of a heating element of the ink jet recording head, wherein the ink jet recording head comprises:

an individual channel in which the heating element is placed for heating ink to produce a bubble;

an ink discharge portion at an edge of the individual channel; and a data holding unit that stores the channel volume data based on a channel volume of the individual channel from the heating element to the ink discharge portion.

* * * * *